United States Patent [19]

Hernandez et al.

[11] 4,243,480

[45] * Jan. 6, 1981

[54] PROCESS FOR THE PRODUCTION OF PAPER CONTAINING STARCH FIBERS AND THE PAPER PRODUCED THEREBY

[75] Inventors: Henry R. Hernandez, Somerville; Donald S. Greif, Bound Brook; Albert N. Barna, Plainfield, all of N.J.; Douglas S. Thornton, Himsdale, Mass.

[73] Assignee: National Starch and Chemical Corporation, Bridgewater, N.J.

[ * ] Notice: The portion of the term of this patent subsequent to Feb. 13, 1996, has been disclaimed.

[21] Appl. No.: 842,543

[22] Filed: Oct. 17, 1977

Related U.S. Application Data

[63] Continuation-in-part of Ser. No. 670,360, Mar. 25, 1976.

[51] Int. Cl.[3] ..... D21H 5/12

[52] U.S. Cl. ..... 162/141; 162/145; 162/146; 162/157 R

[58] Field of Search ..... 162/146, 157 R, 175, 162/141, 142, 176, 145; 264/184, 186, 185; 106/210, 213, 217; 127/33

[56] References Cited

U.S. PATENT DOCUMENTS

| | | | |
|---|---|---|---|
| 1,682,293 | 8/1928 | Lilienfeld | 264/187 |
| 2,570,449 | 10/1951 | Horsak | 264/186 |
| 2,792,765 | 5/1957 | Kerridge et al. | 162/141 |
| 2,902,336 | 9/1959 | Hiemstra et al. | 264/186 |
| 3,114,672 | 12/1963 | Schott | 162/146 |
| 3,116,351 | 12/1963 | Wohlrabe et al. | 264/186 |
| 3,293,057 | 12/1966 | Rumberger | 106/213 |
| 3,839,144 | 10/1974 | Louden | 162/141 |

FOREIGN PATENT DOCUMENTS

| | | | |
|---|---|---|---|
| 847431 | 4/1960 | United Kingdom | 264/186 |

OTHER PUBLICATIONS

"Freeness Scale Interconversion" TAPPI Data Sheet (1945).

*Primary Examiner*—Peter Chin
*Attorney, Agent, or Firm*—James & Franklin

[57] ABSTRACT

A process for the production of paper and paperboard is disclosed wherein water-insensitive starch fibers, produced by extrusion of a starch dispersion into a coagulating solution, are employed to replace all or part of the cellulosic or other pulp conventionally employed. There is also disclosed a method for the incorporation of functional additives into paper during the production thereof; and a method for binding fibers in non-woven webs.

18 Claims, No Drawings

PROCESS FOR THE PRODUCTION OF PAPER CONTAINING STARCH FIBERS AND THE PAPER PRODUCED THEREBY

CROSS REFERENCE TO RELATED APPLICATION

This application is a continuation-in-part application of Ser. No. 670,360 filed Mar. 25, 1976.

BACKGROUND OF THE INVENTION

I. Field of the Invention

This invention is directed to a process for producing paper using water-insensitive starch fibers to replace all or part of the cellulosic or other pulp conventionally employed, and to the paper produced thereby. The invention also relates to a novel method for the production of certain specialty papers, as well as to methods for the incorporation of functional additives into paper during the production thereof and for binding fibers in non-woven webs.

II. Brief Description of the Prior Art

Various natural fibers (other than cellulose) as well as a variety of synthetic fibers have been employed in making paper, however, all these replacements have failed to provide a commercially acceptable substitute for cellulose due to their cost, poor bonding properties, chemical incompatibilities, difficulty in handling in papermaking systems, etc. While it has also been suggested to use starch fibers in various aspects of the papermaking process, commercial attempts to use such fibers have not resulted in any degree of success and paper is still being manufactured almost completely from wood-based cellulosic ingredients—the supply of which is being rapidly depleted.

It is apparent that the aqueous systems normally employed in the paper making operations require pulp fibers possessing sufficient water-insensitivity that they can be used in all aspects of the manufacturing process throughout a relatively wide pH range without losing their integrity. In this regard, the few references which suggest the replacement of starch fibers for cellulose fibers (e.g. U.S. Pat. No. 1,682,293) require chemical modification of the starch in order to radically change its naturally occurring properties prior to forming the fiber so as to provide the degree of water-insensitivity required in the papermaking process. Alternatively, other references (e.g., U.S. Pat. No. 2,570,449) require that the papermaking process itself be modified as by replacing the conventionally employed aqueous system with an alcohol solvent in which the starch fibers are not soluble. It will be recognized that the use of such techniques is both impractical and uneconomical when employed on a commercial basis.

As another aspect of the papermaking operation, it is often necessary to incorporate additives into the pulp in order to achieve specific end properties. Thus, additives such as pigments, latices, synthetic microspheres, fire retardants, dyes, perfumes, etc. are often employed in the manufacture of paper. The efficient retention of these additives at the wet end of a paper machine presents difficulty to the manufacturer since that portion which is not retained creates not only an economic loss, but also a significant pollution problem if it becomes part of the plant effluent. Furthermore, such additives are also added via coating or saturation processes commonly known in the art. These processes usually require that excess heating energy be consumed to re-dry the paper after coating. Moreover, in some instances the coating systems are required to be solvent based which then creates extreme capital expense and requires regulation to recover volatile materials.

It is therefore an object of the present invention to provide a commercially viable process for the use of starch fibers as a partial or complete replacement for cellulose in conventional papermaking operations.

It is also an object to provide a process which efficiently enables the retention and incorporation of additives into paper during the manufacture thereof.

It is a further object to provide a process which enables water-insoluble additives to be introduced into the paper as fiber encapsulated additives.

Another object is to provide ordinary and improved specialty papers according to such process.

A further object of the invention is to provide an efficient and economical process for binding synthetic and/or natural fibers in non-woven web form.

These and other related objects will be apparent from the description which follows.

SUMMARY OF THE INVENTION

In accordance with the present invention, it has been found that the above and related objects are attained when water-insensitive starch fibers, produced by the precipitation of a colloidal dispersion of starch in a coagulating salt solution, are employed as partial or complete replacements for cellulose and similar fibers in conventional paper and paperboard manufacturing operations. The fibers may be used to extend the pulp, as a means for incorporating additives into the paper product, as binder for the fibers in non-woven webs or for any combination thereof.

As used herein, the term "paper and paperboard" includes sheet-like masses and molded products made from fibrous cellulosic materials as well as such fibrous materials as may be derived from synthetics (such as polyamide, polyester, rayon and polyacrylic resin), mineral fibers (such as asbestos and glass), and the like.

As used herein, the expression "conventional papermaking operation" means the process of introducing an aqueous slurry of wood cellulose fibers (which have been beaten or refined to achieve a level of fiber hydration and to which a variety of functional additives can be added) onto a screen or similar device in such a manner that the water is removed, thereby forming a sheet of the consolidated fibers which, upon pressing and drying, can be processed into dry roll or sheet form. Also included within the scope of this expression are the conventional processes for the production of wet and dry-laid non-wovens.

Thus, in one aspect the present invention provides a feasible, efficient and economical process for extending existing raw material sources. Further, it allows the paper manufacturer a far greater degree of flexibility in his operations: he is able to obtain starch fibers in dry or wet-slab form and store them for subsequent use or he may incorporate the starch fiber manufacturing process into his plant as an integrated step in his plping and/or papermaking operations.

Moreover, the present invention offers the manufacturer a new means for incorporating additives into paper products with increased retention and consequently less economic loss and fewer pollution problems. As previously discussed, it is common practice in the manufacture of paper to introduce additives in conjunction with the fibers used in the pulp. Such additives are incorporated in order to achieve specific paper properties other than what is contributed by the fiber itself. Such additives include materials which function as pigments (titanium dioxide, for example) as well as other materials introduced into paper to achieve such properties as improved brightness, opacity, smoothness, ink receptivity, fire retardance, water resistance, increased bulk, etc. As an additional embodiment of the present invention, it has been found that when starch fibers are produced so as to contain various functional additives, and such fibers are then utilized in the aqueous paper making process, retention of the additives is greatly increased when compared with that achieved using current methods. In addition to the increased retention, a further advantage of the addition of additives in this manner is the fact that there is no necessity for relying upon the sensitive charge balance relationship between the cellulose fiber additive and the flocculant (e.g., alum) or other retention aids. Indeed, it is unnecessary to use a flocculant or retention aid with the starch fibers used in the present invention.

It has also been found that non-woven webs can be produced in wet or dry-laid form in accordance with the present invention wherein starch fibers are incorporated within the web to serve as binders therefor. The starch fibers may be retained in the final web or, if the base fiber employed in the web is non-combustible, may be removed, depending upon the desired end use.

Specifically, the present invention is directed to an improvement in a process for manufacturing paper and paperboard comprising the steps of introducing an aqueous slurry of a fibrous pulp material onto a screen in such a manner that the water is removed thereby forming a sheet of consolidated fibers which, upon pressing and drying, yields the final paper product. The improvement comprises the step of replacing from 1 to 100% by weight of the pulp with water-insensitive starch fibers of 10 to 500 microns in diameter produced by extruding a thread-like stream of a colloidal dispersion of the starch, at 5 to 40% by weight solids, into a moving coagulating bath comprising an aqueous solution of a coagulating salt selected from the group consisting of ammonium sulfate, ammonium sulfamate, mono-basic ammonium phosphate, di-basic ammonium phosphate and mixtures thereof, the solution containing the coagulating salt in an amount at least sufficient to coagulate the starch.

DETAILED DESCRIPTION OF THE PREFERRED EMBODIMENTS

The process of the present invention may readily be adapted to be used on any conventional paper making equipment using the procedures commonly used in the specific plant, with the only difference residing in the substitution of starch fibers for all or part of the cellulose pulp.

The starch fibers employed may be produced using a number of variations, the only requirement being that the waterinsensitive fibers have a diameter of 10 to 500 microns and that they be precipitated by the extrusion of a thread-like stream of a colloidal dispersion of starch at 5–40%, by weight solids, into a suitable moving coagulating salt solution.

Fibers may be employed which are produced from any naturally occurring or fractionated starch. Thus, corn starch, waxy maize, rice, tapioca, wheat, potato, high amylose corn starch, commercial amylose powder, etc. may be employed with naturally occurring corn starch, tapioca and waxy maize being preferred due to their economy and availability.

The concentration of the starch solids in the dispersion should be about 5 to 40% by weight. While higher concentrations of starch solids may be used, the resulting dispersions become very viscous and special equipment is required to handle them. The particular concentrations employed in the dispersions will however, affect the properties of the final fiber and the desired end use. As an example, starch fibers prepared from 5% solids dispersions have been found to be particularly useful in the production of glassine or greaseproof papers while starch fibers prepared from 15% solids dispersions have been found better suited for use in more porous papers such as filter paper.

The particular starch employed must be used in the form of a colloidal dispersion. For the purposes of this invention, the term "colloidal dispersion" means dispersion of starch which is substantially free of granules and which exhibits, on standing at the temperature at which it is to be used, little evidence of gelation or precipitation. This state of dispersion may be obtained using a variety of techniques depending upon the particular starch base employed, the desired end use and the equipment available.

When native starches that are very high in amylopectin content, such as waxy maize, are employed, a suitable colloidal dispersion may be prepared merely by thoroughly cooking the starch in water with no chemical additives or modifications required. In most cases where starches which contain less than about 95% amylopectin are employed, it will be desirable to chemically derivatize or modify the starch to ensure its colloidal dispersion before adding it to the aqueous system. The derivatization or modification is carried out to an extent which will insure the production of the desired colloidal dispersion without affecting the ability of the starch to subsequently precipitate. Alternatively, if there is no objection to the presence of caustic in the system, the latter starches may be dispersed in aqueous sodium hydroxide, potassium hydroxide or other common alkali. As further alternatives, the starch bases may also be dispersed in a minor amount of an organic solvent such as dimethylsulfoxide and then added to water, or the starch base may be dispersed in conjunction with chemical additives such as urea and/or paraformaldehyde. In the cases where causticizing is employed, the amount of alkali used must be sufficient to adequately disperse the starch. Typical amounts of alkali used when sodium hydroxide is emplyed are from 15 to 40%, by weight, based on the weight of the starch.

In preparing the starch dispersion, the starch is added to the dispersing medium and vigorously agitated until a state of colloidal dispersion is achieved. In the case of dilute dispersions of starch (i.e. about 5–10% starch solids by weight), this will require about 45 minutes, with longer periods and/or moderate heat required for more concentrated starch dispersions or for certain chemically modified starch bases.

Most of the starch dispersions, including those of waxy maize and most of the chemically modified starches, may be cooled to room temperature prior to introduction into the coagulating bath. In the case of a few of the less chemically modified starches, it will be preferred to employ the dispersions at approximately the elevated temperatures at which they are prepared so as to maintain the necessary colloidal dispersion and to insure efficient fiber production.

The coagulating bath used in preparing the starch fibers employed in the present invention comprises an aqueous solution containing specific ammonium salts selected from the group consisting of ammonium sulfate, ammonium sulfamate, mono- and dibasic ammonium phosphate and mixtures thereof. It is also possible to combine the above-mentioned functional salts with other compatible salts which will form a starch precipitate so as to obtain satisfactory coagulation and a fibrous product. Suitable salts for this purpose include ammonium persulfate, ammonium carbonate, ammonium bromide, ammonium bisulfite, ammonium nitrite ammonium nitrate, ammonium bicarbonate, ammonium oxalate, sodium and potassium chloride, sodium and potassium sulfate, among others. Generally, no advantage is seen in using these additional salts since the ammonium sulfate, sulfamate or phosphate salts must still be present in their respective minimum amount in order to effect coagulation. The only instances where the presence of substantial amounts of other salts may be desirable is in the use of the recycled coagulation bath wherein salts are present which have been generated in situ, as will be discussed hereinbelow.

The minimum concentration of the salt required to effect coagulation as well as the preferred salt or salt blend will vary depending upon the particular starch base employed. For example, in the case of waxy maize starch, it is necessary for ammonium sulfate to be present in amounts of at least 35%, by weight of the total solution, ammonium sulfamate 72% (saturation), di-basic ammonium phosphate 37% and mono-basic ammonium phosphate 40%. In the case of corn starch or similar starches containing about 64–80% amylopectin, lower concentrations of salt may be used with ammonium sulfate required in amounts of 20%, ammonium sulfamate 50%, mono-basic ammonium phosphate 25% and di-basic ammonium phosphate 30%. In the case of hybrid corn starches containing less than about 50% amylopectin, ammonium sulfate must be present in amounts of at least 15%, ammonium sulfamate 40%, di-basic ammonium phosphate 25% and mono-basic ammonium phosphate 20%.

It will be recognized that alkali salts are generated in the coagulating bath when causticized starch dispersions are employed, with satisfactory production of the desired starch fibers continuing until the level of the generated salt is relatively high. The generated salt tolerance level above which production of the fibers becomes inefficient will vary depending upon such factors as the specific salt employed, the total salt solids employed, the starch solid concentration in the dispersion, the amount of amylopectin in the starch base, etc. Once this salt tolerance level is determined, a steady-state system may be achieved at this maximum level (or less) by the periodic addition of ammonium sulfate on a continuous basis. As an example, when sodium hydroxide is used as a dispersing medium and the starch mixture is extruded into an ammonium sulfate coagulating bath, sodium sulfate is generated. In this case, it has been found that production of corn starch fibers (13% solids dispersion) will continue at a satisfactory level until a maximum of about 70 parts sodium sulfate per 30 parts ammonium sulfate (44% solids solution) is present in the bath. Above this level of sodium sulfate, production of the starch fibers becomes less efficient and the resulting fibers tend to lose their individual integrity. However, by adding a small amount of an inorganic acid to the initial coagulating bath or to the bath during formation of the fibers, the level of the generated salt in the system may be appreciably raised before production of the fibers is seriously affected. Thus, using the example discussed previously, the addition of as little as 3 parts of sulfuric acid per hundred parts of the initially charged coagulating bath salt results in a tolerance level of 90 parts sodium sulfate per 10 parts ammonium sulfate thereby increasing the longevity of the coagulating bath.

It is apparent that the salt solution used in the fiber forming process may be recycled and used again once the fibers have been removed. It is, however, important that the salt concentration be maintained, especially where the salt is being depleted through a chemical reaction involving the starch dispersion as it is introduced. In this regard, the starch dispersions which do not contain caustic present little difficulty in recycling other than that the solids content of the salt be maintained. However, in those cases where causticized starch dispersions are employed, chemical reactions with the coagulating solution will occur. For example, if ammonium sulfate is used, the reaction results in the formation of ammonium gas and sodium sulfate. The recycling of such a system can be extended by recovering the ammonia in an acid scrubber and returning it to the system as ammonium sulfate. The generated sodium sulfate can be used in the coagulating bath as part of the salt blend until the tolerance levels discussed previously are attained or can be used as a raw material in other aspects of the pulp or papermaking operation, e.g. as a source of "salt cake" in the production of Kraft pulp.

Starch fibers can be produced at any temperature at which the starch dispersion can be handled. Generally, the coagulation bath is maintained at about room temperature (20° C.) during production of the fibers, however, temperatures as high as about 70° C. may be used. These higher temperatures may be desired under certain conditions since they increase the solubility of the salt in the coagulating bath resulting in more concentrated solutions. Thus, when it is desired to produce waxy maize fibers using mono-basic ammonium phosphate as coagulant, it is desirable to increase the temperature of the bath so as to obtain a concentration of salt of approximately 40% (saturation level for the mono-basic ammonium phosphate at 20° C. is 28%).

In preparing the starch fibers used in the invention, the starch dispersion is introduced continuously or by drops in the form of a thread-like stream into the moving coagulating salt solution. This introduction may be accomplished either from above or below the salt solution using any conventional techniques. Thus, the dispersion may be extruded through an apparatus containing at least one aperture, such as a spinnerette, a syringe or a biuret feed tube. Alternatively, the dispersion may be discharged under pressure from a pipe or tube containing a plurality of apertures into a surrounding enclosed area, e.g. a concentric pipe, containing the moving coagulating solution. Various adaptations of the above and related techniques may be used and the fibers may be thus produced using either batch or continuous operations.

In accordance with either embodiment, the aqueous salt coagulating solution should be moving when the starch dispersion is introduced and the directionality of the two flows can also be utilized in controlling fiber lengths and diameters or widths. Thus, if the salt solution is moving in a direction generally concurrent with the flow of the starch dispersion, rounder fiber lengths are formed; if the starch dispersion is introduced at an angle of about 90° to the flow of the salt solution, relatively flatter fibers are formed. Generally aperatures of 10 to 500 microns in diameter are preferred, in order to produce fibers of the size required herein. Thus, the starch fibers used in the present invention have diameters (widths) of 10 to 500 microns and will generally have lengths of from about 0.1 to 3.0 mm. if they are to be used as cellulose pulp replacements in paper. For non-woven application, fibers of longer lengths may be employed.

It will be recognized that the length, cross-sectional size and configuration of the resultant fibers are dependent upon a number of interrelated parameters in addition to those described hereinabove. Thus, the viscosity, the solids content of the starch dispersion, as well as the particular components used in the coagulating solution and/or starch dispersion and the relative flow viscosities thereof are additional factors which can be used in conjunction with the parameters discussed previously in order to control the dimensions of the resultant fiber.

This and similar coagulating processes producing starch fibers useful herein are described in our co-pending patent application Ser. No. 670,342 filed on even date herewith, now U.S. Pat. No. 4,139,699 the disclosure of which is included herein by reference, as well as in U.S. Pat. No. 2,902,336. Various modifications of the processes may also be employed as long as the final fiber possesses sufficient water insensitivity to be employed in the papermaking operation.

The resulting aqueous slurry or suspension of starch fibers may be used directly by introducing it into the pulp stream thereby enabling production of fibers and paper web "inline" in the paper manufacturing plant. If this embodiment is to be used, it is generally preferred to first wash the fibers free of coagulating salt prior to introducing the slurry into the paper manufacturing operation. Alternatively, the fibers may be recovered in the dry state by collecting from water on a screen or similar device. It is then preferably to reslurry the fibers into a non-aqueous solvent such as methanol, ethanol, isopropanol, acetone or the like in which the fibers are not soluble. The fibers are then recovered, as by filtration, from the solvent and dried. Other methods such as centrifuging, flash-drying or spray-drying may also be used to remove the water. Once dried, the fibers may be re-introduced into an aqueous medium and will exhibit excellent re-dispersibility maintaining their discrete, discontinuous structure. Alternatively, the fibers may be recovered from the slurry, as by filtration, washed and placed in water at levels of up to about 50% solids and formed into "wet-slabs" for subsequent use.

It is also to be noted that the starch employed may be chemically treated to vary the properties of the fiber produced or to help effect formation of the colloidal dispersion. Alternatively, the starch fibers may be treated after formation in order to produce certain functional characteristics. Thus, the starch may be chemically treated, as by aminoethylation, in order to provide rapid dispersibility of the starch in the dispersion, which treatment will also result in the production of a fiber which possesses a cationic charge when employed in an aqueous medium. Similarly, a starch may be used which is modified to contain anionic groups so as to be stable in a dispersion and which, after regeneration, will produce a fiber having anionic properties. The fibers may also be modified after their formation in order to achieve specific functional properties. Thus, improved anionic functionality might be obtained by bleaching the fibers after precipitation as long as the conditions are not so severe as to destroy the fibers. The properties of the fibers may also be controlled by using blends of modified and unmodified starches or by the addition of other functional materials, such as polyacrylic acid, to obtain the specifically desired properties.

As one of the advantages of the method of the present invention there is provided a means to improve paper products in a variety of manners due to the properties which are either inherent in or which may be imparted to the starch fiber itself. As an example of such improved properties, we may consider the production of such diverse specialty papers as glassine paper and filter paper which require special treatment when conventionally produced.

Glassine paper is made from pulps in which the quality of the fiber permits a high degree of hydration. It is the mechanical treatment of the pulp while suspended in water that causes the distinctive greaseproof properties. The fibers are fibrillated and swollen to an almost gelatinous condition. When paper is made from hydrated fibers, a dense non-porous sheet is formed on the wire. The resultant sheet is resistant to the penetration of greases and oils because it is composed of nearly continuous well hydrated cellulose. To get the cellulose in this well hydrated form requires a considerable amount of energy. Glassine manufacturers must subject their stock to refining for extended periods of time or increase the number of refiners through which the stock must pass. Once the stock is hydrated and introduced on the wire it drains very slowly. As a result, machine speeds are limited to between 150–500 fpm depending somewhat upon the basis weight of the paper. The stock temperature may be elevated with steam to accelerate water removal on the wire. Attempts by glassine manufacturers to use cationic polyelectrolytes for improving drainage has met only limited success. The flocculation of the fibers may improve drainage but this disruption in formation can cause pinholes which reduce oil and greaseproof properties of the product.

We have now found that when starch fibers are combined with cellulose fibers which have been beaten to a degree less than would be required in conventional glassine manufacture, the resultant mixture has a significantly higher freeness and will drain at lower temperatures in about one-third the time usually required at the elevated temperatures presently used, with higher wet mat solids after pressing and improved drying efficiency relative to the conventional glassine stock. Moreover, the resultant sheet properties of this novel paper exhibits greater internal strength (Z-directional strength), improved oil holdout properties and greater resistance to the passage of air relative to conventional glassine paper. It is apparent that the reduction of the cellulose refining requirements can result in significant energy savings since the fiber mix need not be elevated in temperature to achieve acceptable water removal rates as is common practice in conventional glassine manufacture.

Starch fibers may also be employed to provide a more porous sheet which is a property that can be desirable in such papers as filter or saturating grades. In prior art methods, reduced refining of cellulose has been found to aid the development of this property, but does so only at the expense of weaker web strength. The incorporation of starch fibers according to the present invention, in conjunction with the cellulose, can result in a more porous sheet structure while maintaining, and often improving, the required strength properties.

As a further feature of the invention it is possible to incorporate certain hydrocolloids in the dispersing medium and to extrude the hydrocolloids together with the starch in order to produce a starch-hydrocolloid fiber which may be used in the papermaking process of the present invention. In order to achieve this fiber composition, it is only necessary that the hydrocolloid (in minor amounts, i.e. less than 50% by total solids weight), together with the starch portion, be placed in a state of colloidal dispersion prior to contact with the coagulating bath. Thus, in the case of water-dispersible hydrocolloids such as polyvinyl alcohol, carboxymethylcellulose, hydroxyethylcellulose, etc., it is only necessary to add the hydrocolloid to the water in which the starch is dispersed. In the case of other hydrocolloids, such as casein, it will be necessary to causticize the dispersion in order to form the colloidal dispersion required.

As an alternative embodiment of the present invention, water-insoluble additives may be uniformly admixed throughout the starch dispersion and subsequently encapsulated within the resultant starch fiber. Thus, water-insoluble additives, including pigments, metallic powders, latices, oils, plasticizers, microspheres (glass beads, foamed silica or other low density materials either in blown or unblown form), etc., may be encapsulated within the starch fibers of the invention. In a similar manner, water-insoluble synthetic polymers or latices, such as polyvinyl acetate, polyacrylonitrile, polystyrene, etc., may be incorporated within the fiber. It will also be noted that the density of the starch fibers may be varied by incorporating air or other gases in the starch dispersion prior to passing it into the coagulating bath.

It is to be further noted that certain water-soluble solid additives may also be co-extruded with the starch fibers. In such cases, the additive will be dissolved in the aqueous starch dispersion and the coagulating bath which is employed in forming the starch fibers will be adjusted by the addition of a sufficient quantity of a compatible salt capable of precipitating the additive. As an example, a commercial rosin size can be added to the starch dispersion and extruded into a coagulating bath containing the functional starch-coagulating salt together with sufficient aluminum sulfate to precipitate the rosin, thereby forming a co-precipitated starch-aluminum rosinate fiber.

The water-insolubility of the starch fibers of the present invention can be further enhanced by the incorporation of conventional cross-linking agents, such as urea-formaldehyde, glyoxal, urea-melamine-formaldehyde, Kymene (registered tradename of Hercules, Inc., Wilmington, Delaware), etc. These crosslinking agents may be incorporated into the starch dispersion prior to extrusion or may be post-added to the starch fiber.

Generally, any additives employed will be used in amounts less than about 50% by weight of the total solids, however, certain additives including clay and pigments may be incorporated at levels up to about 80% by weight. It will be realized that the specific additive selected for incorporation, as well as the amount employed in any of the above-described embodiments, will depend upon what properties are desired in the final fiber. Thus, pigmented fibers show improved opacity and may be incorporated by conventional methods into the fibrous web with overall improved pigment retention relative to that obtained by merely adding pigment to a paper stock system. Fire retardant properties may be conveyed to a substrate by incorporating polyvinyl chloride powder and antimony trioxide or other fire retardant chemicals within the starch fiber. Starch fibers containing microspheres may be incorporated into paper webs at high levels of retention. The retention of such spheres enables the production of sheets of high bulk and low weight as compared with cellulose sheets of comparable weight. In conventional sheets containing microspheres, the presence of the microspheres between the fibers has a debonding effect on the fibers and this results in a sheet of low strength. In contrast, the sheets of the present invention possess excellent strength properties as the spheres are encapsulated within the starch fibers so that the debonding effect on the spheres is minimized. The density of the starch fibers, and resultant paper, may also be varied by the incorporation of air or other gases in the starch dispersion prior to passage into the coagulating bath.

Furthermore, by using additive encapsulating fibers it will be possible, not only to provide a novel process of incorporating additives in paper, but also to produce novel effects in the paper itself. As an example, there are papermaking machines that produce a final web which is constructed of individual layers compressed together. Such equipment may be described as cylinder machines or Fourdriniers with a second down-line headbox or with multiple headboxes. Machines of this type normally use lower quality fibers for the inner plies and quality pulp as the top liner. By utilizing a pigmented starch fiber in the top line, production of paper web having the surface properties of coated board is possible. In essence a coated board would be produced via a wet-end application process due to the high concentration of starch and pigment at the substrate surface. Alternatively, special decorative or construction paper could be manufactured having different colored sides. Dyed fiber could be prepared at various colors and fed to two different headboxes. Such twocolored sided paper is prepared today but requires the use of surface applications during processing.

One of the advantages of the use of water-insoluble synthetic polymers encapsulated within the starch fiber is that it permits a high retention in paper and paper-like webs of synthetic fibers (such as rayon, acrylic, polyester, nylon or polypropylene). Most of these fibers carry very low surface charge and therefore their retention in commonly used latex binder systems, which rely upon precipitation and fiber deposition techniques, are poor. Such poor retention can result in low binder efficiency and problems with foam, sticking and accumulation of polymer in the system. The resin encapsulating starch fiber insures efficient retention and provides the desired end sheet properties.

An additional feature of the present invention is that the starch fibers may also be employed in the production of dry laid nonwovens of synthetic fibers. In such applications, a web is produced using air as the medium for depositing the fibers on a moving wire. Since the synthetic fibers are not hydrated, bonding is inhibited and relatively weak and soft structures are produced. Thus, in order to provide integrity to the web, it is necessary to spray a binder on its surface. In accordance with the present invention, it is possible to blend dry starch fibers with the synthetic fibers. Such a method would be particularly advantageous in the area of disposable nonwovens wherein the biodegradable properties of the starch fiber would be superior to those obtained with the presently employed synthetic fiber binders. As binders those fibers particularly high in amylopectin content are preferred. It is to be noted that the starch fiber may be retained in the final non-woven web or removed therefrom if desired. If the starch fiber is to be removed, as for example, from a ceramic web, exposure to ashing conditions sufficient to burn off the starch fibers provides a suitable means for removal thereof.

The starch fibers, filled or unfilled, may be successfully used alone in the formation of an all-starch paper product or may be utilized in conjunction with all types of cellulosic or non-cellulosic fibers. The hardwood or softwood cellulosic fibers which may be used include bleached and unbleached sulfate (kraft), bleached and unbleached sulfite, bleached and unbleached soda, neutral sulfite, semi-chemical groundwood, chemi-groundwood and any combination of these fibers. These designations refer to wood pulp fibers which have been prepared by means of a variety of processes which are conventionally used in the pulp and paper industry. In addition, synthetic cellulosic fibers of the viscose rayon or regenerated cellulose type can be used, as well as recycled waste papers from various sources. Similarly, ceramic fibers, glass, asbestos or other inorganic fibrous materials may be employed in conjunction with the starch fibers of the invention.

Due to the water-insensitive nature of the starch fibers employed herein, the fibers disperse readily to form stable dispersions which may be used in ordinary papermaking operations without adding surfactants. This permits the use of the fibers in paper making operations and machinery without modification of the usual processing conditions. Thus, fibers may be added to the beater or a blending chest into the head box onto the screen of a Fourdrinier machine and from there the sheet may be carried to the wet press through drier rolls, calenders, and woundup as a sheet without modifying substantially the normal operating characteristics of the machines as used for making cellulose paper. It will be appreciated that in the case of paper made entirely from starch fibers, it may be desirable to place the web between nylon mesh screens or to blot the web drier than is common in conventional operations in order to prevent sticking of the fibers in the drier.

Furthermore, the papermaking operations may be integrated with the starch fiber production operation by employing the slurry containing the fibers as they are precipitated. It is also possible to form shaped articles directly from thick fiber slurries by slush-molding in patterns or molds.

It will be obvious to those skilled in the art that the specific starch employed and the amount of starch fiber used will vary according to the desired quality paper. Thus, we have found that the choice of the proper type of starch makes it possible to achieve selected sheet properties previously achieved only by hydrating and fibrillating wood pulp to various degrees of freeness. Specifically, it has been necessary to lightly refine pulp (650 ml. CSF) in unbleached kraft linerboard applications to insure rapid water removal rates while maintaining high processing speeds. The degree of refining is controlled also by the internal bond strength of the product being produced. The introduction of starch fiber enables rapid water removal and maintenance of production speed but still insures the development of internal bond strength. Glassine papers are frequently processed from pulp that has been refined extensively (less than 50 ml. CSF). We have now found that glassine type papers can be produced by reducing the cellulose refining in half by adding as little as 15% starch fiber. Alternatively, for papers which require even lower opacity and porosity, it will be preferable to use starch fibers in larger quantities, i.e. about 50% or more.

The starch fiber containing papers of the present invention may be manufactured together with any commonly employed internal additives such as sizes, wet and dry strength additives, etc. or may be surface treated by coating, spraying or saturating as is conventional in the trade.

The starch fiber-containing paper of the present invention can be repulped and recycled. The ability of the starch fiber itself to retain its fiber integrity during a repulping process is influenced by the starch fiber type (higher amylose starches repulp more readily) and the repulping conditions to which it is subjected. Generally, the lower the usage of basic chemicals and elevated temperatures during the repulping operation, the more favorable the recycling of the starch fiber.

The following examples will serve to more fully explain the various aspects and embodiments of the present invention. In the examples, all parts are by weight unless otherwise indicated.

EXAMPLE 1

A slurry was prepared by mixing a naturally occurring unmodified starch composed of 70% amylose and 30% amylopectin in water at a level of 5%, by weight, solid starch and then adding with agitation, a 25% solids solution of sodium hydroxide sufficient to provide a level of 40% caustic on the starch on a dry basis. This mixture was agitated until a dispersion of the starch granules was obtained.

The resultant dispersion was introduced at a pressure of 703 gms/sq. cm. into an agitated coagulation bath consisting of 28% solids ammonium sulfate through a spinnerette containing 100 apertures, each of which had a diameter of 70.2 microns, at an angle of 90° to the moving salt solution. The resultant fibers were collected on a wire mesh screen, washed free of salt and recollected. The fibers possessed an average diameter of 65 microns, an average length of approximately 4 mm., and a final solids content of 23.5%, by weight.

A series of handsheets were prepared on a Noble and Wood sheet mold, from varying levels of bleached softwood pulp (BSWK) in combination with the above prepared fibers. The sheets were dried on the Noble and Wood dryer at a drum temperature of 121° C. and then allowed to condition for a period of 24 hours under constant 22° C. temperature and 55% relative humidity.

Table I summarizes the pertinent sheet making conditions and test data.

TABLE I

| Fiber Blend | | Basis Weight | Canadian | Sheffield | |
|---|---|---|---|---|---|
| BSWK | Starch Fiber | gms/sq. m. | Standard Freeness (ml)(1) | Porosity(2) | Z-directional Strength(3) |
| 100 | 0 | 78.1 | 544 | 218 | 596 |
| 90 | 10 | 82.6 | 540 | 192 | 630 |
| 75 | 25 | 80.4 | 475 | 74 | 846 |
| 50 | 50 | 77.9 | 367 | 28 | 1050+ |

TABLE I-continued

| Fiber Blend | | Basis Weight | Canadian | Shef- | |
|---|---|---|---|---|---|
| BSWK | Starch Fiber | gms/ sq. m. | Standard Freeness (ml)(1) | Poros- ity(2) | Z-directional Strength(3) |
| 25 | 75 | 77.1 | 250 | 16 | 1050+ |

(1)Measure of the drainage of water from the pulp through a wire screen. Unbeaten pulps have a high freeness relative to low freeness of well beaten pulps. TAPPI test T227-M-58.

(2)This test measures the air resistance of paper. Specifically, it measures the volume of air that can be passed through a specific sample area at a given pressure and time. The higher the test value, the more porous the sheet (Used 7.62 cm. I.D. ring; values are unitless).

(3)The Scott Internal Bond Tester measures the Z-directional strength of paper. This method is designed to determine the average force in joules per square meter required to separate a paper specimen. TAPPI RC-305.

The results shown in the Table indicate that the presence of increasing amounts of this particular starch fiber prepared at a 5% solids dispersion level extends the water holding capabilities of the fiber blend and produces a sheet that is less porous and of higher Z-directional strength than a 100% cellulose sheet.

EXAMPLE 2

Starch fibers were produced using the materials and method employed in Example 1, however, after the final wash, the fibers were dispersed in ethanol solution, collected and allowed to dry. The fibers were then combined with cellulose and handsheets prepared as in Example 1. Tests performed on these handsheets show that the dried fiber provided performance characteristics comparable to those obtained by the moist fibrous products of Example 1.

EXAMPLE 3

Starch fibers were produced using the materials and methods employed in Example 1, however, the starch solids concentration of the starch dispersion was 20% and the final solids level in the fiber was 38%. Handsheets were prepared and tested as in Example 1. The results are shown in Table II.

TABLE II

| Fiber Blend | | Basis Weight | Canadian | | |
|---|---|---|---|---|---|
| BSWK | Starch Fiber | gms/ sq.m. | Standard Freeness (ml) | Sheffield Porosity | Z-directional Strength |
| 100 | 0 | 86.2 | 505 | 158 | 538 |

TABLE II-continued

| Fiber Blend | | Basis Weight | Canadian | | |
|---|---|---|---|---|---|
| BSWK | Starch Fiber | gms/ sq.m. | Standard Freeness (ml) | Sheffield Porosity | Z-directional Strength |
| 90 | 10 | 82.9 | 545 | 333 | 527 |
| 75 | 25 | 82.9 | 595 | 1,215 | 565 |
| 50 | 50 | 79.7 | 676 | 8,645 | 647 |
| 25 | 75 | 79.7 | 814 | 50,496 | 1035+ |

As illustrated in Table II, the use of starch fibers prepared from a higher solids level dispersion resulted in an increase in the water releasing ability of the furnish (i.e., the freeness), and provided a more porous sheet of greater porosity and Z-directional strength than a 100% cellulose sheet. It is to be noted that this starch level produced freeness and porosity values which distinctly contrast from the values obtained in Example 1 wherein a 5% starch solids level was used to produce fibers. This comparison illustrates the adaptability of the method of the present invention to the production of a variety of properties in the final paper product (e.g., the level of porosity required in a glassine stock versus that required in filter paper). It is also to be noted that in both Example 1 and 3, the strength of the paper was improved by the use of starch fibers.

EXAMPLE 4

Starch fibers were prepared using a 20% solids starch dispersion as in Example 3 except that after washing they were reslurried in ethanol, recovered and dried. Handsheets were prepared and tested and showed that the dried fiber provided performance characteristics comparable to those obtained using the moist fibrous product of Example 3.

EXAMPLE 5

This example illustrates the use of fibers formed from a variety of starch bases in the production of paper according to the present invention.

Starch fibers were prepared and combined with cellulose using the methods described in Example 1. The cellulose portion was beaten to a Canadian Standard Freeness of 645 ml prior to being blended with the starch fiber and the basis weight of the handsheets was maintained at 97.5 gms/sq. m.

TABLE III

| Fiber Blend | | | | | | |
|---|---|---|---|---|---|---|
| BSWK | Starch Fiber | Starch Fiber Base | Tensile[1] gms/cm$^2$ | Mullen[2] gms/cm$^2$ | Z-directional[3] Strength | MIT[4] Fold |
| 100 | 0 | — | 1040.55 | 4429.40 | 145 | 552 |
| 90 | 10 | Aminoethylated corn | 1462.4 | 6679.26 | 903 | 1,210 |
| 70 | 30 | Aminoethylated corn | 1476.46 | 5624.64 | 1050+ | 1,280 |
| 90 | 10 | Waxy maize | 1525.68 | 6679.26 | 853 | 1,670 |
| 70 | 30 | Waxy maize | 1413.19 | 5062.17 | 1050+ | 1,125 |
| 90 | 10 | Unmodified corn | 1553.80 | 5484.02 | 567 | 1,340 |
| 70 | 30 | Unmodified corn | 1293.66 | 3445.09 | 1050+ | 1,245 |
| 90 | 10 | Hybrid corn containing 70% amylose | 1659.26 | 5273.10 | 622 | 1,420 |
| 70 | 30 | Hybrid corn containing 70% amylose | 1652.23 | 4148.17 | 1050+ | 1,390 |
| 90 | 10 | Amylose | 1545.99 | 5413.71 | 683 | 1,433 |

TABLE III-continued

| Fiber Blend | | | | | | |
|---|---|---|---|---|---|---|
| BSWK | Starch Fiber | Starch Fiber Base | Tensile[1] gms/cm² | Mullen[2] gms/cm² | Z-directional[3] Strength | MIT[4] Fold |
| 70 | 30 | Amylose | 1652.23 | 4780.94 | 1050+ | 1,395 |

[1]TAPPI method T404-5s-66 - Determines the tensile breaking strength in pounds per inch (converted to metric units).
[2]TAPPI method T403-ts-63 - The hydrostatic pressure in pounds per sq. inch (converted) required to rupture the paper when the pressure is applied at a controlled increasing rate through a rubber diaphragm to a circular area 3048 cm. in diameter.
[3]As defined in Example 1.
[4]TAPPI method T423M-50. The number of folds that the test specimen can endure prior to breaking using a fold tester of the type developed at the Massachusetts Institute of Technology.

As shown in Table III the addition of any of the various starch fibers may be used to improve particular strength properties of the paper when compared with the 100% cellulose fiber sheet.

EXAMPLE 6

This example illustrates two methods for the production of a 100% starch fiber sheet.

Method A. Six grams of unmodified corn starch fibers were slurried in 1 liter of water. The fibers were agitated with a paddle stirrer until a uniform mixture was obtained. A handsheet was formed on the Noble and Wood sheet former that had been fitted with a 100 mesh wire screen. The resultant fibrous web was removed from the screen and blotters and subjected to a series of pressing operations: 3 presses at 7030.8 gms/cm² and 3 presses at 28123.2 gms/cm² with changing of the blotters between pressing operations. The resulting mat solids was 70%. The web was then placed between blotters and dried on the Noble and Wood dryer at 120.1° C. The resultant rigid self-supporting paper-like product had a basis weight of 145 gms/sq.m.

Method B. Starch fibers were processed as described in Method A and the resultant web mat was subjected to a pressing sequence of: 2 presses at 7030.8 gms/cm² and 2 presses at 14061.6 gms/cm² with changing of the blotters between pressing operations such that the resultant wet mat solids was 50%. The web was placed between two nylon wire screens and passed through the Noble and Wood dryer at 120.1° C. The resultant rigid self-supporting paper-like web had a basis weight of 145 gms/sq.m.

EXAMPLE 7

Handsheets were prepared by the method of Example 1 except that commercially unmodified refined glassine stock at two freeness levels was combined with corn starch fibers. The cellulose pulp was obtained from two points in the refinery operation such that one portion had a Schopper Reigler freeness of 350 ml. while the fully refined portion had a 160 ml. freeness. Starch fiber was substituted at the 20% level and all handsheets were prepared at a basis weight of 48.8 gms/m². The sheets were then surface sized on a laboratory size press fitted with rubber rolls using a 1% solids polyvinyl acetate solution (available from Air Products and Chemicals under the tradename Vinol 165) maintained at 60° C. such that a 1% pick-up of polyvinyl acetate was obtained. The sheets were then conditioned under constant temperature of 20° C. and room humidity 55% for 24 hours prior to being tested for terpentine resistance using TAPPI standard T454-ts-66. The results of the terpentine testing are shown in Table IV.

TABLE IV

| Cellulose S.R. Freeness* | Parts | Starch Fiber | Sheet Mold Drain Time | Stock Temp. °C. | Terpentine Test |
|---|---|---|---|---|---|
| 350 ml | 100 | — | 21.3 secs. | 24 | 855 secs. |
| 350 ml | 80 | 20 | 19.9 secs. | 24 | 1800+ secs. |
| 160 ml | 100 | — | 62.1 secs. | 60 | 1800+ secs. |

*Schooper-Riegler Freeness Tester supplied by Testing Machines, Inc.

The use of starch fiber in combination with partially refined pulp increased the terpentine resistance of that pulp alone and matched the resistance of a fully refined glassine stock. In addition, the refining reduction enabled drain time reductions by a factor of almost 3 fold at significantly lower temperatures. Thus while it is necessary to elevate conventional stock to temperatures of about 60° C. in order to obtain drainage in 62 seconds, drainage in about 20 seconds can be achieved at temperatures of 24° C. with no loss in desirable properties using the method of the present invention. The improved drainage can result in faster machine speeds and efficiency of production while realizing considerable savings in energy due to reduced refining and stock temperatures.

EXAMPLE 8

This example illustrates the improvement in properties obtainable by the incorporation in cellulose pulp of starch fibers containing polymeric microspheres.

Starch fibers were prepared using the method of Example 1 but also incorporating into the starch dispersion, prior to fiber formation, 8.5% microspheres (available from Dow Chemical as XD 6850). The fibers were then incorporated into handsheets in combination with cellulose wood pulp using the method described in Example 1. In all cases, the Canadian Standard Freeness value was 730 ml. for the cellulose component. The results of testing are shown in Table V. As a means of comparison, samples were also prepared in which the microspheres were added directly to the paper pulp as is conventionl practice in the industry.

TABLE V

| Fiber Blend | | % Spheres | | Basis | | Taber[2] | |
|---|---|---|---|---|---|---|---|
| BSWK | Starch Fiber | Added | In Sheet | Weight gms/sq.m. | Caliper[1] 1 × 10³ cm. | Stiff-ness | Z-directional[3] Strength |
| 100 | 0 | 0 | 0 | 97.6 | 18.79 | 3.7 | 111 |
| 100 | 0 | 0 | 0 | 130.1 | 24.38 | 6.3 | 137 |
| 100 | 0 | 1.8 | .86 | 97.6 | 24.39 | 6.6 | 103 |
| 100 | 0 | 2.0 | 1.0 | 97.6 | 25.40 | 7.1 | 90 |

TABLE V-continued

| Fiber Blend | | % Spheres | | Basis | | Taber[2] | |
|---|---|---|---|---|---|---|---|
| BSWK | Starch Fiber | Added | In Sheet | Weight gms/sq.m. | Caliper[1] $1 \times 10^3$ cm. | Stiff-ness | Z-directional[3] Strength |
| 95 | 5 | .43 | .43 | 97.6 | 23.11 | 5.0 | 168 |
| 90 | 10 | .86 | .86 | 97.6 | 26.16 | 6.3 | 206 |
| 85 | 15 | 1.29 | 1.29 | 97.6 | 28.45 | 7.5 | 237 |

[1]Thickness of paper expressed in thousandths of a centimeter
[2]TAPPI Method T451-M-60
[3]As defined in Example 1.

As illustrated in Table V, the introduction of the microspheres by either of the methods substantially improved both the caliper and stiffness of the paper product. In this regard, it was possible by the addition of microspheres to achieve the caliper and stiffness of 130 g/sq.m. basis weight at a level of only 97.6 g/sq.m. The weight saving, both in amount of fiber required and in related costs recognized after production of the paper (e.g. mailing), are readily recognizable.

When the other properties obtained from the microsphere containing sheets were compared, it was found that retention of the externally added spheres was approximately 50% of the amount initially added while the retention was approximately 100% for those added in the encapsulated fibers. Moreover, there was a decrease in strength and evidence of non-uniform distribution of the spheres (with a greater concentration on the felt side) in the case of the externally added spheres while these factors were not present in the case of the starch encapsulated spheres. Thus, the increase in caliper and stiffness observed using the conventionally employed external addition of the spheres was obtained only at the expense of decreasing internal bond strength of the paper, while introducing the spheres within the starch fiber insured their retention with the sheet while increasing the internal bond strength in addition to providing the desired stiffness and caliper increases.

EXAMPLE 9

This example illustrates the results obtained using three methods for incorporating clay in paper production.

Handsheets were prepared using methods similar to those described in Example 1. The handsheets were prepared so as to incorporate a number two coating grade clay in the final sheet during the formation process. The incorporation of the clay into the handsheets was accomplished in three different manners: (1) by conventionally slurrying the pigment with the pulp fibers, (2) by incorporating starch fibers prepared according to Example 1 but containing 80% clay and 20% starch, and (3) using a combination of methods (1) and (2). In all cases the basis weight of the sheet was 97.6 g/sq.m.

The physical and optical properties of the resulting paper sheets are shown in Table VI.

TABLE VI

| Conventional Addition | | | Starch Fiber | | | | |
|---|---|---|---|---|---|---|---|
| % Cellulose | % Clay | % $TiO_2$ | % Starch | % Clay | Opacity(1) | Tensile(2) | Z-directional(3) Strength |
| 100 | 0 | 0 | 0 | 0 | 85.9 | 991.34 | 302 |
| 87.2 | 12.8 | 0 | 0 | 0 | 92.0 | 625.74 | 113 |
| 75.2 | 0 | 0 | 5.0 | 19.8 | 88.9 | 1371.00 | 351 |
| 68.4 | 6.8 | 0 | 5.0 | 19.8 | 90.5 | 864.79 | 256 |
| 72.1 | 0 | 4.5 | 4.7 | 18.7 | 94.1 | 850.73 | 233 |

(1)TAPPI method T425-m-60. Expressed in percent and defined as 100 times the ratio of the diffuse reflectance of a specimen backed with a blank of no more than .005 reflectance of the same specimen backed with a white body having an absolute reflectance of 0.89. The higher the value the more opaque the paper.
(2)Defined in Example 5.
(3)Defined in Example 1.

As illustrated in Table VI, incorporating the pigment within the starch fiber enabled higher pigment loadings and strength properties when compared to conventional pigment loading techniques. Thus, when 12.8% clay was added to cellulose pulp using conventional techniques, the tensile and Z-directional strength decreased. In contrast, when 19.8% clay was added in the form of encapsulated starch fibers (a total addition of 24.8%), the tensile and Z-directional strength improved. It is further shown that the reduction in opacity obtained by use of the clay-encapsulated fiber can be compensated for by the external addition of a small amount of clay or of titanium dioxide.

EXAMPLE 10

This example illustrates the superior retention ability of the starch fibers as used in the method of the present invention.

Bleached softwood kraft was beaten to a freeness of 500 ml. Canadian Standard and divided into three portions. To one portion, a No. 2 coating grade clay was added and the resultant blend agitated until the pigment was uniformly distributed throughout the pulp fibers. Another portion was treated in the same manner except that Natron 86 (a trademark of National Starch and Chemical Corporation), a retention aid, was added. To the remaining portion of the pulp, starch fibers containing clay encapsulated therein (50% starch and 50% clay) were added and the fiber blend was agitated until uniform distribution was obtained. Handsheets were prepared by a method similar to Example 1 and the sheets for clay content and percent retention. The results are shown in Table VII.

TABLE VII

| Fiber Blend BSWK | Starch Fiber (50% Clay) | Clay | Retention Aid | % Clay Retention |
|---|---|---|---|---|
| 90 | 0 | 10 | 0 | 11 |
| 90 | 0 | 10 | 0.02% | 35 |
| 80 | 20 | 0 | 0 | 97 |

As illustrated in Table VII, the retention of clay was highest when the clay was encapsulated in the starch fiber pursuant to the present invention.

EXAMPLE 11

The following example illustrates the use of starch fibers for their binding properties in the production of a multi-ply sheet.

Two-ply handsheets were prepared on a Noble and Wood sheet former from bleached softwood kraft that had been beaten to a 500 ml. Canadian Standard Freeness. To achieve a final basis weight of 146 gms. per square meter, two plies (each approximately 73 gms. per square meter) were prepared and wet pressed together prior to drying on the Noble and Wood drier at 121° C. The control handsheet contained 100% cellulose in both plies, while the test handsheet had 20% of the cellulose in the top ply replaced by starch fiber. The bond between the plies was tested using the Scott Internal Bond tester and the results shown in Table VIII.

TABLE VIII

| Fiber Blend Bottom Ply - Top Ply | Z-directional Strength(1) |
|---|---|
| 100% Cellulose - 100% cellulose | 119.7 |
| 100% Cellulose - 80% cellulose and 20% Starch Fiber | 197.4 |

(1)Defined in Example 1.

As shown in Table VIII the presence of the starch fiber increased the bond strength between the plies of the final sheets.

EXAMPLE 12

This example shows the production of paper containing a variety of additives incorporated by the addition of starch fibers containing the encapsulated additives.

In a manner similar to that described in Example 8, additives were encapsulated within the starch fibers and used to form handsheets having a given percentage of the starch fibers as indicated in Table IX.

TABLE IX

| Additive | % Additive in Starch Fiber | % Addition of Starch Fibers in Pulp |
|---|---|---|
| $TiO_2$ | 25 | 20 |
| $CaCO_3$ | 25 | 20 |
| Al powder | 25 | 20 |
| Carbon black | 25 | 20 |
| Fibran 68 (A trademark for a sizing agent available from National Starch and Chemical Corporation) | 5 | 10 |
| Pexol 200 (A trademark for a sizing agent available from Hercules Powder Co.) | 5 | 10 |
| A 1:1 blend of antimony trioxide and vinyl chloride homopolymer (fire retardant | 50 | 50 |
| Tris-dichloro-propyl phosphate (fire retardant) | 57 | 40 |

In all cases, the additives were retained at a high level in the final paper product and imparted their characteristic property thereto.

EXAMPLE 13

This example illustrates the use of the starch fibers as a means to incorporate latex binders in a nonwoven web of synthetic fibers.

A dispersion of rayon fibers (0.635 cm, 1.5 denier) and polyester fibers (0.635 cm, 1.5 denier) were prepared at 0.1% solids in separate containers.

A 100% starch fiber product as well as a starch fiber that contained 20% on a weight basis of encapsulated latex, vinyl acetate/butyl acrylate copolymer, were added as binders in amounts such that the final fiber blend would contain 25% of the starch fiber products. Handsheets were prepared on a Noble and Wood sheet former at a basis weight of 65 gms. per square meter using methods similar to those described in Example 1. The webs were tested to determine tensile strength improvement and the results summarized in Table X.

TABLE X

| Starch Fiber Description | Binder Level | Synthetic Fiber | Tensile(1) (gms/cm$^2$) |
|---|---|---|---|
| None (control) | — | Rayon | * |
| None (control) | — | Polyester | * |
| 100% Starch | 25% | Rayon | 710.11 |
| 100% Starch | 25% | Polyester | 217.95 |
| 80% Starch - 20% latex | 25% | Rayon | 984.31 |
| 80% Starch - 20% latex | 25% | Polyester | 135.69 |

*Sheet did not possess sufficient integrity to measure tensile
(1)Defined in Example 5.

As shown in Table X, webs prepared using both the starch fibers and the starch-latex fibers as binders possessed superior tensile strength. In contrast, control webs prepared from 100% synthetic fiber did not possess sufficient integrity to even be handled for testing. It is noted that the particular latex employed increased the tensile strength of the rayon web while decreasing the strength of the polyester web compared to the 100% starch fiber. This illustrates the necessity of choosing the proper latex for the synthetic fiber being treated.

EXAMPLE 14

This example illustrates the use of starch fibers as binders with ceramic fibers. The example also shows that the starch fiber binders may be removed after formation of the web resulting in the production of a 100% ceramic fiber sheet.

A 3% solids ceramic fiber slurry was prepared in a Waring Blender and agitated for 1 minute after 0.2% NaOH (dry basis based on the weight of the fiber) was added to serve as a dispersing agent. The fiber mix was then transferred to a container that was equipped with a paddle stirrer and a pre-determined amount of starch fiber added from a 1% solids mix. After mixing the blend for a period of 5 minutes, handsheets were prepared at 407 gms/square meter basis weight, on the Noble and Wood sheet former. As a control, a ceramic sheet was made without the addition of any starch fibers. All sheets were subjected to strength tests with the results shown in Table XI.

TABLE XI

| Starch Fiber | Basis Weight gms/sq. meter | Tensile[1] gms/cm$^2$ |
|---|---|---|
| 0 | 407.5 | —* |
| 5% | 407.5 | 3.52 |
| 10% | 407.5 | 20.39 |

*Sheet did not possess sufficient integrity to measure tensile
[1]Defined in Example 5.

The sheets containing the starch fibers were then placed in a kiln maintained at a temperature sufficient to ash the starch fibers and fuse the ceramic fibers. A well bonded ceramic web was thereby produced.

EXAMPLE 15

Two ply handsheets containing 10% $TiO_2$ on the final sheet weight of approximately 145 gms/sq.m. were prepared. In the control handsheets, $TiO_2$ was added in the conventional manner by dispersing the pigment with those unbleached kraft fibers which comprised the top liner. In the remaining handsheets, 20% $TiO_2$ encapsulated starch fiber on a weight basis was added in sufficient quantity to the top liner to provide 10% $TiO_2$ on the final sheet weight.

The final sheet was constructed from two plies, each prepared separately on the Noble and Wood sheet mold at approximately 72.5 gms/sq.m., removed from the wire and pressed together in the wet mat state at 14061.6 gms/cm$^2$. The sheets were then dried on the Noble and Wood drier at 121° C. Brightness readings were taken on the top liner side in accordance with TAPPI standard R452-M-58 with the results indicated in Table XII.

TABLE XII

| Sample Sheet | Top Liner Brightness |
|---|---|
| Control | 26.2 |
| Starch Fiber | 30.1 |

The results shown in Table XII indicate that the handsheets prepared using the $TiO_2$ encapsulated starch fibers had superior properties to those prepared using conventional methods.

The preferred embodiments of the present invention having been described above, various modifications and improvements thereon will now become readily apparent to those skilled in the art. Accordingly, the spirit and scope of the present invention is to be limited not by the foregoing disclosure, but only by the appended claims.

We claim:

1. In a process for manufacturing paper and paperboard comprising the steps of introducing an aqueous slurry of a fibrous pulp material onto a screen in such a manner that the water is removed thereby forming a sheet of consolidated fibers which, upon pressing and drying, yields the final paper product, the improvement comprising the step of replacing from 1 to 100% by weight of said pulp material with water-insensitive starch fibers of 10 to 500 microns in diameter, said fibers being produced by extruding a thread-like stream of a colloidal dispersion containing starch at 5–40% by weight solids, wherein said starch is present in an amount more than 50% by weight of the fiber forming ingredient, into a moving coagulating bath comprising an aqueous solution of a coagulating salt selected from the group consisting of ammonium sulfate, ammonium sulfamate, mono-basic ammonium phosphate, di-basic ammonium phosphate and mixtures thereof, the solution containing the coagulating salt in an amount at least sufficient to coagulate the starch, said starch fibers further characterized in retaining fiber integrity when dispersed in an aqueous medium.

2. The process of claim 1 wherein the starch fibers are prepared from corn starch or waxy maize starch.

3. The process of claim 1 wherein the starch fibers are prepared from high amylose starch.

4. The process of claim 1 wherein the starch fibers are prepared from cationically derivatized starches.

5. The process of claim 1 wherein the starch fibers are prepared from ether or ester derivatives of starch.

6. The process of claim 1 wherein the colloidal starch dispersion additionally includes clay or pigment replacing said starch in an amount up to 80% by weight.

7. The process of claim 1 wherein the colloidal starch dispersion additionally includes a water-insoluble additive selected from the group consisting of microspheres, metallic powders, latices, oils and plasticizers replacing said starch in an amount less than 50% by weight.

8. The process of claim 1 wherein the colloidal starch dispersion additionally includes a dispersed hydrocolloid replacing said starch in an amount less than 50% by weight.

9. The process of claim 1 wherein the starch fibers have a length of 0.1 to 3.0 mm.

10. The process of claim 1 wherein the remaining fibrous pulp material is substantially in the form of wood cellulose.

11. The process of claim 1 wherein the remaining fibrous pulp material is substantially in the form of fibers selected from the group consisting of polyester fibers, rayon fibers, ceramic fibers, glass fibers and asbestos fibers.

12. The process of claim 1 wherein 1–50% by weight of the fibrous pulp is replaced by water-insensitive starch fibers.

13. The process of claim 12 wherein at least a portion of said unreplaced fibrous pulp has been refined to a Schopper Reigler freeness of between about 350 ml. to 160 ml., and said final paper product having glassine greaseproof properties.

14. The paper or paperboard composition produced by the process of claim 1.

15. The paper and paperboard compositions of claim 14 wherein at least one water-insoluble additive is encapsulated within the starch fiber.

16. The paper of claim 14 wherein 1–50% by weight of the papermaking cellulose pulp fibers is replaced by water-insensitive starch fibers.

17. The paper of claim 14 wherein 1–50% by weight of the papermaking cellulose pulp fibers is replaced by water-insensitive starch fibers and at least a portion of said unreplaced papermaking cellulose pulp fibers has been refined to a Schopper Reigler freeness of between about 350 ml. to 160 ml.

18. A process for incorporating water-insoluble additives within an aqueous papermaking slurry of a conventional papermaking system comprising the steps of thoroughly dispersing at least one water-insoluble additive in a colloidal dispersion containing starch at 5–40% by weight solids, wherein said starch is present in an amount more than 50% by weight of the fiber forming ingredient, and precipitating said dispersion by extruding a thread-like stream of the dispersion into a moving coagulating bath comprising an aqueous solution of a coagulating salt selected from the group consisting of ammonium sulfate, ammonium sulfamate, mono-basic ammonium phosphate, dibasic ammonium phosphate and mixtures thereof, the solution containing the coagulating salt in an amount at least sufficient to coagulate the starch so as to form water-insensitive starch fibers encapsulating said additive; and subsequently using the resulting starch fibers as a component in a papermaking pulp system, said starch fibers further characterized in retaining fiber integrity when dispersed in an aqueous medium.

* * * * *